US008660444B2

(12) United States Patent
Ishida

(10) Patent No.: US 8,660,444 B2
(45) Date of Patent: Feb. 25, 2014

(54) IMAGE FORMING APPARATUS WITH OPERATION STOPPING CONTROL UPON TEMPERATURE SENSING IN FIXING DEVICE

(75) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 845 days.

(21) Appl. No.: 12/707,924

(22) Filed: Feb. 18, 2010

(65) Prior Publication Data

US 2010/0247130 A1 Sep. 30, 2010

(30) Foreign Application Priority Data

Mar. 25, 2009 (JP) ..... 2009-073436

(51) Int. Cl.
*G03G 15/20* (2006.01)

(52) U.S. Cl.
USPC ..... 399/33; 399/69

(58) Field of Classification Search
USPC ..... 399/33, 69
See application file for complete search history.

(56) References Cited

U.S. PATENT DOCUMENTS

| | | | | |
|---|---|---|---|---|
| 7,212,754 | B2 * | 5/2007 | Fujiwara | 399/33 |
| 2002/0057919 | A1 | 5/2002 | Tomatsu | |

FOREIGN PATENT DOCUMENTS

| | | | | |
|---|---|---|---|---|
| JP | 53-166447 | | | 12/1978 |
| JP | 1178992 | A | | 7/1989 |
| JP | H02-199494 | A | | 8/1990 |
| JP | 08234619 | A | * | 9/1996 |
| JP | 11133796 | A | * | 5/1999 |
| JP | 2000-321923 | | | 11/2000 |
| JP | 2002-149002 | | | 5/2002 |
| JP | 2007322883 | A | | 12/2007 |
| JP | 2008083329 | A | | 4/2008 |
| JP | 2009-008744 | A | | 1/2009 |

OTHER PUBLICATIONS

Office Action for Japanese Patent Application No. 2009-073436 mailed Jan. 11, 2011.
Decision to Grant for Japanese patent application No. 2009-073436 mailed May 31, 2011.

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

An image forming apparatus includes a heat source, a thermal fixing member, a temperature sensing unit, a temperature change determining unit and a halting unit. The heat source generates heat. The thermal fixing member is heated by the heat source and performs a thermal fixing operation by thermally fixing a toner image deposited on a sheet of paper. The temperature sensing unit senses a temperature of the thermal fixing member and outputs temperature data. The temperature change determining unit determines that the temperature of the thermal fixing member decreases based on two pieces of temperature data sensed by the temperature sensing unit at two different timings. The halting unit halts the thermal fixing operation when determination made by the temperature change determining unit is consecutively made for a predetermined number of times.

10 Claims, 11 Drawing Sheets

IMAGE FORMING APPARATUS WITH OPERATION STOPPING CONTROL UPON TEMPERATURE SENSING IN FIXING DEVICE

CROSS REFERENCE TO RELATED APPLICATION

This application claims priority from Japanese Patent Application No. 2009-073436 filed Mar. 25, 2009. The entire content of the priority application is incorporated herein by reference.

TECHNICAL FIELD

The present invention relates to an electrophotographic image forming apparatus having a thermal fixing device for fixing a toner image deposited on a recording paper.

BACKGROUND

An electrophotographic image forming apparatus, such as laser printers, includes a thermal fixing device. Typically, the fixing device includes a heat roller and a pressure roller for nipping a sheet of paper therebetween to thermally fix a toner-image deposited on the sheet. The fixing device further includes a temperature-sensing member, such as thermistors, for sensing temperature of the heat roller and a control unit controls the temperature thereof to fall within a predetermined range.

The fixing device further includes a thermostat for preventing the heat roller from being overheated. Overheat of the heat roller may be caused by runaway of the control unit. If the thermostat is actuated to interrupt the electrical connection, a heating source for heating the heat roller is disconnected from a power supply so that overheat of the heat roller can be prevented.

SUMMARY

In view of the foregoing, it is an object of the invention to provide an image forming apparatus in which an image forming operation is halted at a proper timing if a thermostat is actuated.

This and other objects of the invention will be attained by an image forming apparatus including a heat source, a thermal fixing member, a temperature sensing unit, a temperature change determining unit and a halting unit. The heat source generates heat. The thermal fixing member is heated by the heat source and performs a thermal fixing operation by thermally fixing a toner image deposited on a sheet of paper. The temperature sensing unit senses a temperature of the thermal fixing member and outputs temperature data. The temperature change determining unit determines that the temperature of the thermal fixing member decreases based on two pieces of temperature data sensed by the temperature sensing unit at two different timings. The halting unit halts the thermal fixing operation when determination made by the temperature change determining unit is consecutively made for a predetermined number of times.

BRIEF DESCRIPTION OF THE DRAWINGS

The particular features and advantages of the invention as well as other objects will become apparent from the following description taken in connection with the accompanying drawings, in which.

DETAILED DESCRIPTION

Referring to the accompanying drawings, a laser printer 1 will be described. First, the general configuration thereof will be described with reference to FIG. 1. In the following description, a laser printer 1 will be exemplified as an image forming apparatus, and the terms "upper", "lower", "right", "left" and the like will be used assuming that the laser printer 1 is disposed in an orientation in which it is intended to be used.

Figure 1:
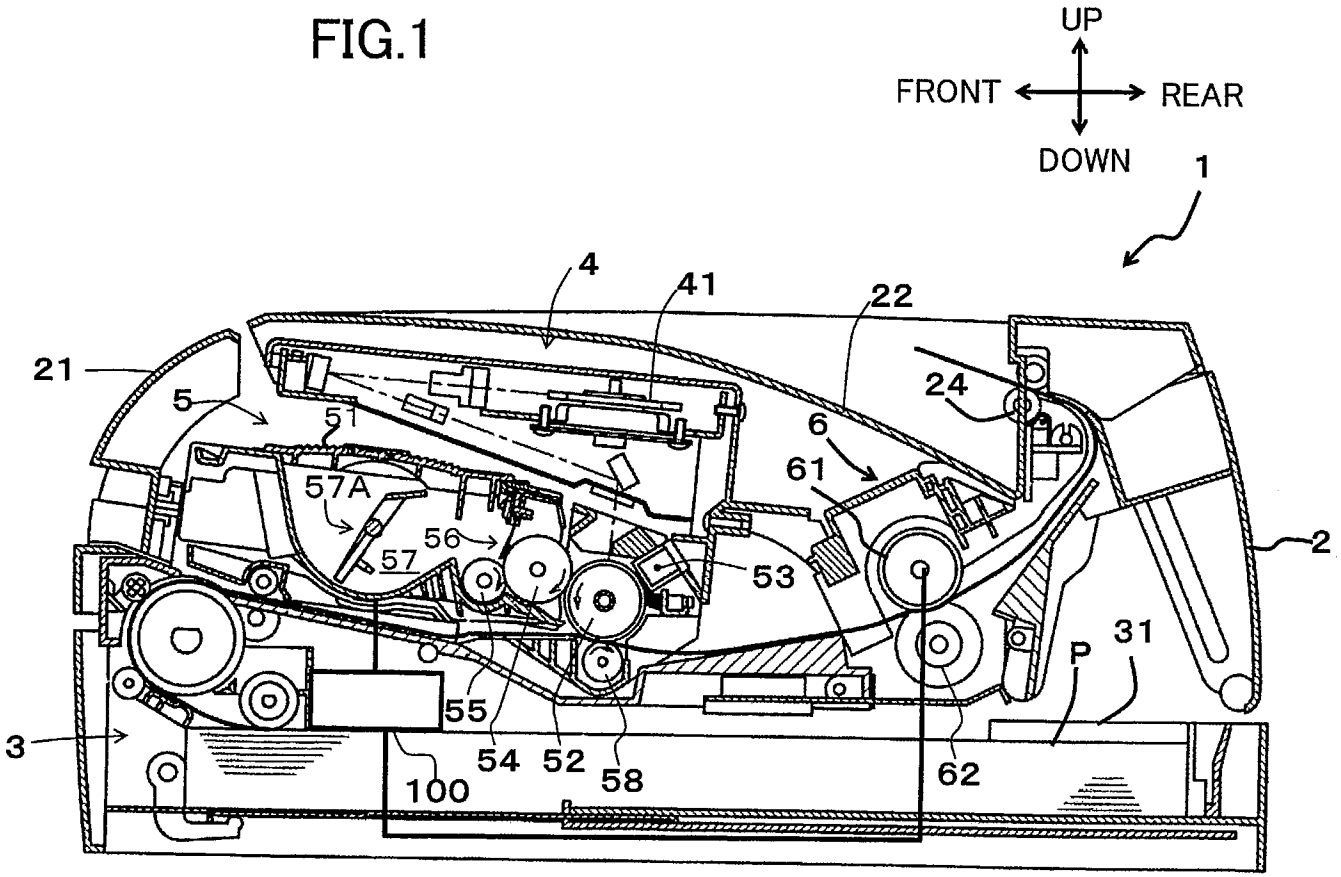
FIG. 1 is a vertical cross-sectional view showing a laser printer according to an embodiment of the invention.

As shown in FIG. 1, the laser printer 1 mainly includes a casing 2, a sheet supply unit 3, an exposure unit 4, a process cartridge 5, and a thermal fixing unit 6. The sheet supply unit 3 supplies a sheet of paper P. The process cartridge 5 transfers a toner image to the sheet of paper P. The thermal fixing unit 6 thermally fixes the toner image transferred to the sheet of paper P. In the front side of the casing 2, a front cover 21 is pivotally movably attached to the casing 2 to close an opening. When the front cover 21 opens, the opening is exposed to allow the process cartridge 5 to mount in or dismount from the casing 2. A discharge tray 22 is formed on an upper surface of the casing 2 for receiving the sheet of paper P discharged out from the casing 2.

The sheet supply unit 3 is provided in a lower portion of the casing 2. The sheet supply unit 3 includes a sheet cassette 31 on which a plenty of sheets P is stacked. The uppermost sheet P in the sheet cassette 31 is conveyed to the process cartridge 5 by virtue of various rollers rotatably disposed in the sheet supply unit 3.

The exposure unit 4 is provided on an upper portion of the casing 2. The exposure unit 4 includes a light source (not shown), a polygon mirror 41, various types of lenses, and reflection mirrors. The light source emits a laser beam based on image data. As illustrated by a dotted line in FIG. 1, the laser beam is irradiated onto a surface of a photosensitive drum 52 accommodated in the process cartridge 5 upon reflection on the mirrors and passing through the lenses.

The process cartridge 5 mounted in the casing 2 is disposed beneath the exposure unit 4. The process cartridge 5 mainly includes the photosensitive drum 52, a charger 53, a developing roller 54, a supply roller 55, a thickness regulating blade 56, a toner accommodating portion 57 and a transfer roller 58, all of which being accommodated in a hollow casing 51.

After the surface of the photosensitive drum 52 is uniformly charged by the charger 53, the laser beam emitted from the exposure unit 4 is scanned at a high speed over the surface of the photosensitive drum 28. As a result, areas of the photosensitive drum 52 that have been exposed to the laser beam have a lower potential and an electrostatic latent image corresponding to the image data is formed.

The toner (not shown) in the toner accommodating portion 57 is supplied to the supply roller 55 by virtue of an agitator 57A provided in the toner accommodating portion 57. Then, as the developing roller 54 and the supply roller 55 rotate while slidingly contacting with each other, the toner is supplied onto the developing roller 54. The toner that has been supplied onto the developing roller 54 is subject to thickness regulation by the thickness regulating blade 56 to have a predetermined toner thickness on the developing roller 54.

Next, the toner on the surface of the developing roller 54 comes into contact with the photosensitive drum 52 as the developing roller 54 rotates and is supplied to areas on the surface of the photosensitive drum 52 that were exposed to the laser beam. In this way, the electrostatic latent image on the photosensitive drum 52 is transformed into a visible image so that a toner image is borne on the surface of the photosensitive drum 52. Then, the toner image borne on the surface of the photosensitive drum 52 is transferred onto the sheet P while the sheet P is conveyed between the photosensitive drum 52 and the transfer roller 58.

The fixing device 6 is disposed at the rear side of the process cartridge 5 and includes a heat roller 61 and a pressure roller 62. The pressure roller 62 is disposed in opposition to the heat roller 61 and nips the sheet P together with the heat roller 61. A detail description of the configuration of the fixing device 6 will be described later.

In the fixing device 6, the toner transferred onto the sheet P at the transfer position is thermally fixed to the sheet P as the sheet P passes between the heat roller 61 and the pressure roller 62. After the toner is fixed to the sheet P, the sheet P is conveyed along a discharge path 23 and discharged onto the sheet discharge tray 22. Upon discharging the image-formed sheet P onto the sheet discharge tray 22, a sequence of an image forming operation terminates.

A control unit 100 is provided in the casing 2. The control unit 100 controls various types of operations, such as image forming operations and heating control operations of the fixing device 6. Specifically, the control unit 100 serves as a temperature change determining unit for determining that the temperature of the heat roller 61 decreases based on the outputs from two thermistors (to be described later). The control unit 100 also serves as a halting unit for halting the image forming operation or thermal fixing operation when determination made by the temperature change determining unit is consecutively for a predetermined number of times.

Figure 2:
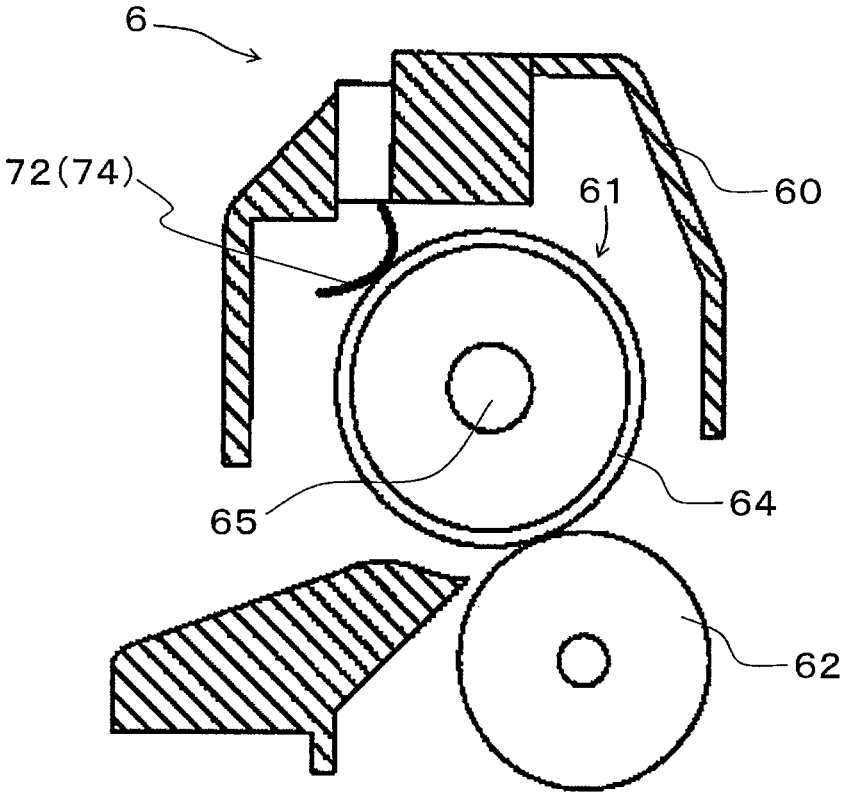
FIG. 2 is a vertical cross-sectional view showing a fixing device contained in the laser printer shown in FIG. 1.
Figure 3:
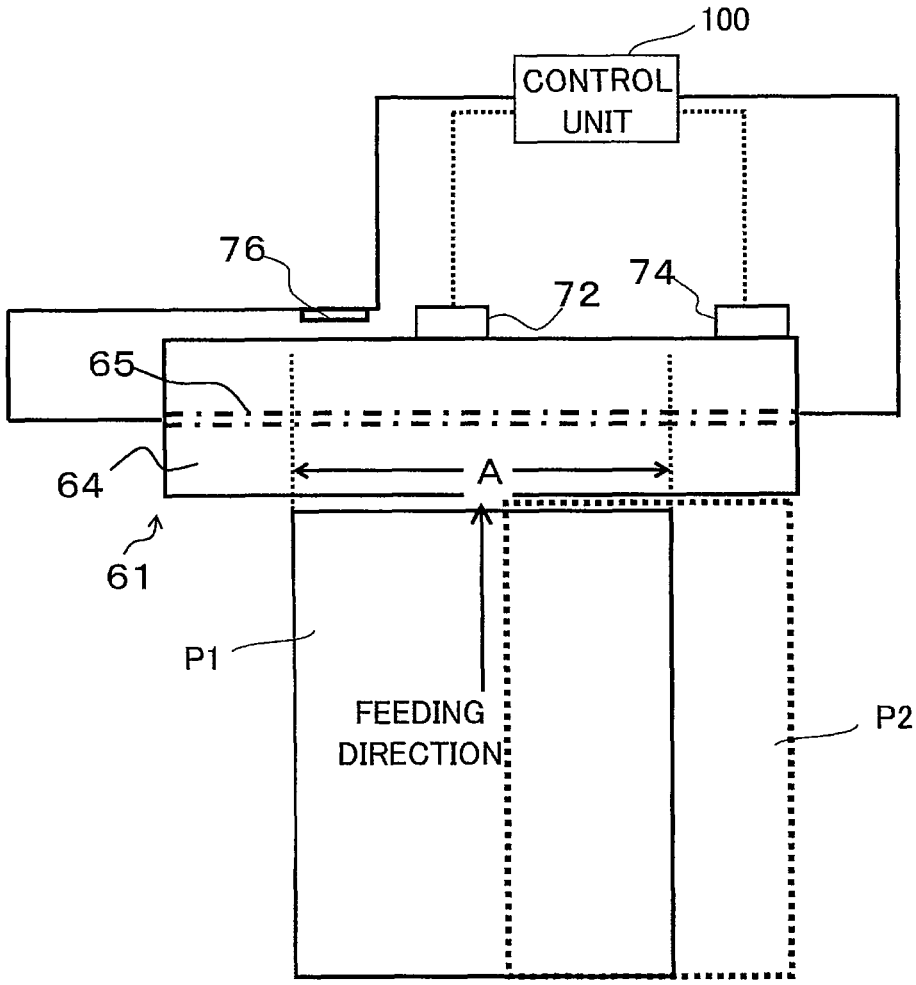
FIG. 3 is an explanatory diagram showing an arrangement of various components in the fixing device.

Next, the configuration of the fixing device 6 will be described with reference to FIGS. 2 through 4. As shown in FIGS. 2 and 3, the heat roller 61 and the pressure roller 62 are housed in a housing 60 of the fixing device 6. In the housing 60, two thermistors 72 and 74 and a thermostat 76 are provided. As can be appreciated from FIG. 3, one thermistor 74 is disposed in an axial end portion of the heat roller 61 and the counterpart thermistor 72 in the central portion of the heat roller 61. Both thermistors are in contact with the outer peripheral surface of the heat roller 61 to sense the temperature in the contact portions. In the following description, the thermistor 74 disposed at the axial end portion of the heat roller 61 will be referred to as first thermistor, and the centrally disposed thermistor 72 as second thermistor.

The heat roller 61 has a metal roller portion 64 and a heat source 65. The metal roller portion 64 is an axially elongated form. The widthwise length of the heat roller 61 is long enough to perform thermal fixing of not only a small-sized sheet but also a large-sized sheet having a width substantially equal to the width of the heat roller 61. In performing the thermal fixing of the small-sized sheet, the sheet may be fed either one of a central course, a right-sided course and a left-sided course. The central course is such a sheet feeding route that the sheet is fed to pass the central part of the heat roller 61. The right-sided course is such a sheet feeding route that the sheet is fed to pass the right portion of the heat roller 61 where the right side of the sheet is held in alignment with the right side edge of the heat roller 61. Similarly, the left-sided course is such a sheet feeding route that the sheet is fed to pass the left portion of the heat roller 61 where the left side of the sheet is held in alignment with the right side edge of the heat roller 61.

The heat roller 61 is rotatably supported in the housing 60. The heat source 65 is disposed at the center of the metal roller portion 64 to be coaxial therewith and extends in the axial direction of the metal roller portion 64 as shown in FIG. 2. The entire length of the heat source 65 is almost equal to the length of the metal roller portion 64. As shown in FIG. 3, the heat source 65 is connected to the control unit 100 and generates heat. Although not shown in FIG. 3, the control unit 100 includes a power source connected to the heat source 65. During the image forming operation, the metal roller portion 64 is heated by the heat source 65 and performs the thermal fixing operation with respect to a toner image deposited on the sheet P.

The first and second thermistors 74, 72 are supported by the housing 60 and the thermostat 76 is connected between the control unit 100 and the heat source 65. The first and second thermistors 74, 72 are located in different positions but are seen to be overlapped when viewed in a direction in which the axis the metal roller portion 64 extends. The first thermistor 74 is held in contact with the right axial end part of the heat roller 61, and the second thermistor 72 a central part of the heat roller 61. More precisely, the part of the heat roller 61 with which the second thermistor 72 is in contact is not an exact center of the lengthwise in the heat roller 61 but is slightly shifted leftward. Both the first and second thermistors 74, 72 are connected to the control unit 100 and apply sensed signals thereto. As such, both or one of the first and second thermistors 74, 72 serve as a temperature sensing unit for sensing a temperature of the metal roller portion 64.

In this embodiment, sheets P1 and P2 which are different in size are selectively used as an image forming medium. The sheet P1 is a large-sized sheet, and the sheet P2 a small-sized sheet smaller in the widthwise length than the sheet P1. In FIGS. 3 and 4, reference character "A" denotes a sheet passing area.

As shown in FIG. 3, when the large-sized sheet P1 indicated by a solid line is centrally set with respect to the axial length of the heat roller 61, the right axial end area of the hear roller 61 with which the first thermistor 74 is in contact is outside the sheet passing area A. As the sheet P1 is fed to pass the sheet passing area A, the heat in the corresponding part of the heat roller 61 is dissipated the temperature sensed by the second thermistor 72 is lowered. On the other hand, the first thermistor 74 correctly senses the temperature of the heat roller 61, so that the control unit 100 selects the sensed signal from the first thermistor 74 as indicating the temperature of the metal roller portion 64.

Figure 4:
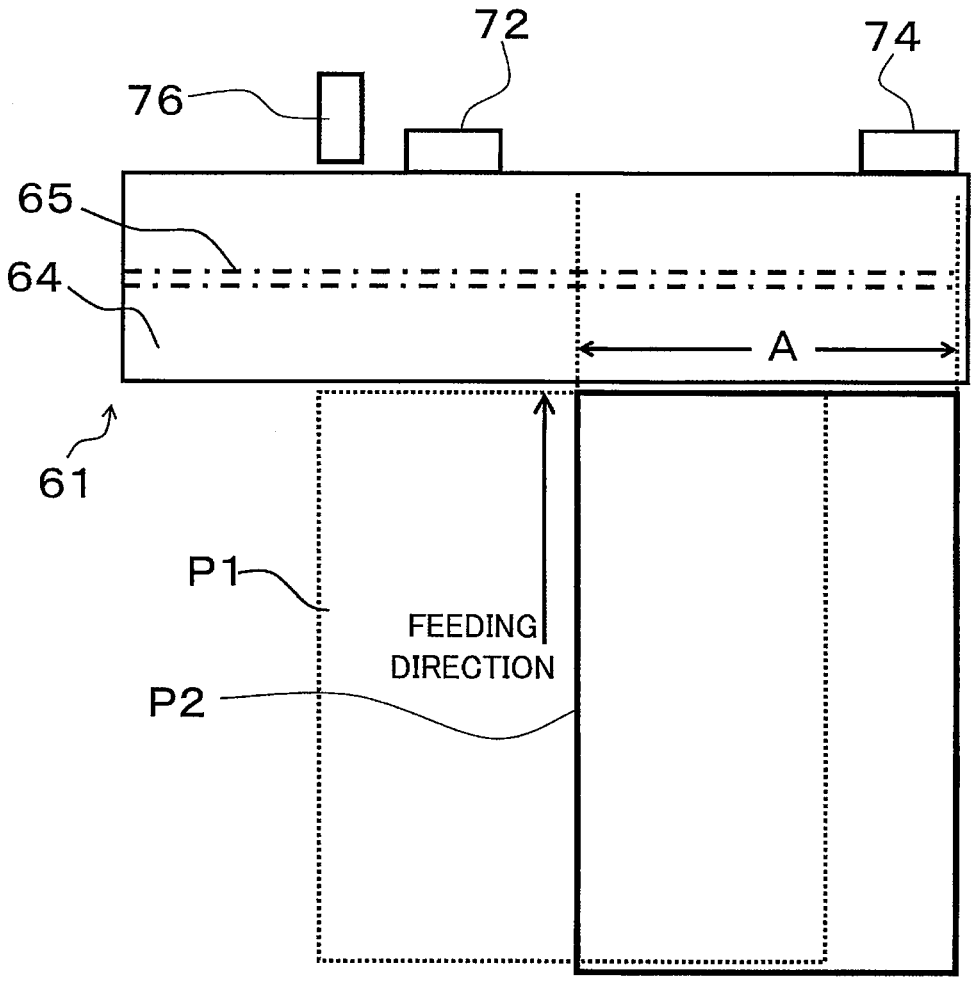
FIG. 4 is an explanatory diagram illustrating the set position of a small-size sheet of paper passing through a nip between a heat roller and a pressure roller of the fixing device.

When the small-sized sheet P2 indicated by a solid line in FIG. 4 is set to right side with respect to the axial direction of the heat roller 61, the second thermistor 72 is out of the sheet passing area A. Accordingly, the second thermistor 72 more correctly senses the temperature of the heat roller 61 than the first thermistor 74, so that the control unit 100 selects the sensed signal from the second thermistor 74 as indicating the temperature of the metal roller portion 64.

Based on the signal received from the relevant thermistor, the control unit 100 performs ON/OFF control of the heat source 65 so that a fixing temperature in the fixing device 6 falls within a predetermined range defined by an upper limit temperature and a lower limit temperature. It should be noted that the first and second thermistors 74, 72 are not limited to a contact type but may be non-contacting type.

The thermostat 76 is provided for preventing the heat roller 61 from being overheated. The thermostat 76 is disposed in confrontation with the metal roller portion 64 with a predetermined spacing interposed therebetween. When the thermostat 76 is actuated, the heat source 65 is disconnected from the control unit 100. In other words, the thermostat 76 serves as a disabling member for disabling the heat source 65 to generate heat. The thermostat 76 is of a disk-shaped and has a bimetal on the surface of the disk. The bimetal is normally electrically in contact with the disk. However, if the ambient temperature reaches or exceeds a predetermined limit, for example, 200° C., the bimetal is deformed to separate from the disk.

In this embodiment, the predetermined limit of the bimetal is set to correspond to a temperature around the upper limit temperature of the allowable temperature range set for the heat roller 61. In lieu of the thermostat 76 with the bimetal, a temperature-sensitive fuse that is formed of electrical resin may be employed. The fuse will melt if the ambient temperature has reached to a critical value.

Figure 5:
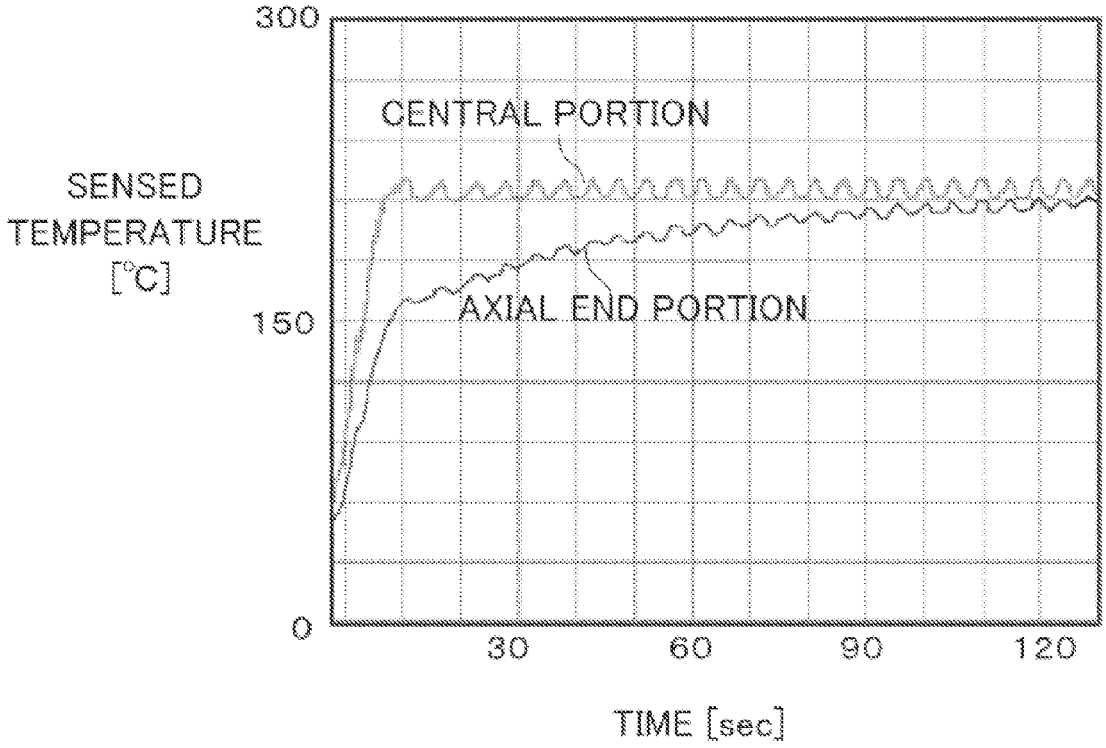
FIG. 5 is a graphical representation showing changes of temperature in central and axial end portions of the heat roller when operated under a normal circumstance in which an environmental temperature is 20° C. and rated voltage is applied to the fixing device.

With the laser printer 1 described above, when an image forming instruction is received at the fixing device 6 from the control unit 100, the energization of the heat source 65 is commenced. The heat roller 61 is heated for a predetermined period of time for warming-up. The surface temperature of the heat roller 61 increases as shown in FIG. 5. After expiration of the warm-up period, the sheet P is fed into the fixing device 6 for thermally fixing a toner image deposited on the sheet P. The fixing temperature is set so that temperature in the central part of the heat roller 61 is 213° C.

When the central area of the heat roller 61 is in contact with the sheet P, the control unit 100 implements ON/OFF control for the heat source 65 so that the fixing temperature is maintained within a predetermined range. The fixing temperature is controlled to fall within a predetermined range between 210 (allowable lowermost fixing temperature) and 216° C. (allowable uppermost fixing temperature). Due to the ON/OFF control implemented for the heat roller 61, the temperature at the central area of the heat roller 61 repeats rise and lowering within the predetermined range, but is normally at around 213° C.

A temperature increase in axial end areas of the heat roller 61 delays as compared to that in the central area. Hence, even if the temperature in the central area of the heat roller 61 reaches the fixing temperature, the temperature in the axial end areas of the heat roller 61 has not yet reached the fixing temperature. After expiration of another predetermined period of time, the temperatures in the axial end areas and the central area of the heat roller 61 reach almost the same degree.

As the image-forming operation is performed, the heat of the central area of the heat roller 61 is dissipated in accordance with the passage of the sheets P. However, the heat is accumulated in the axial end areas of the heat roller 61 with which the sheet P is not brought into contact. Thus, the temperature in the axial end areas of the heat roller 61 becomes little higher than the temperature in the central area of the heat roller 61.

Figure 6:
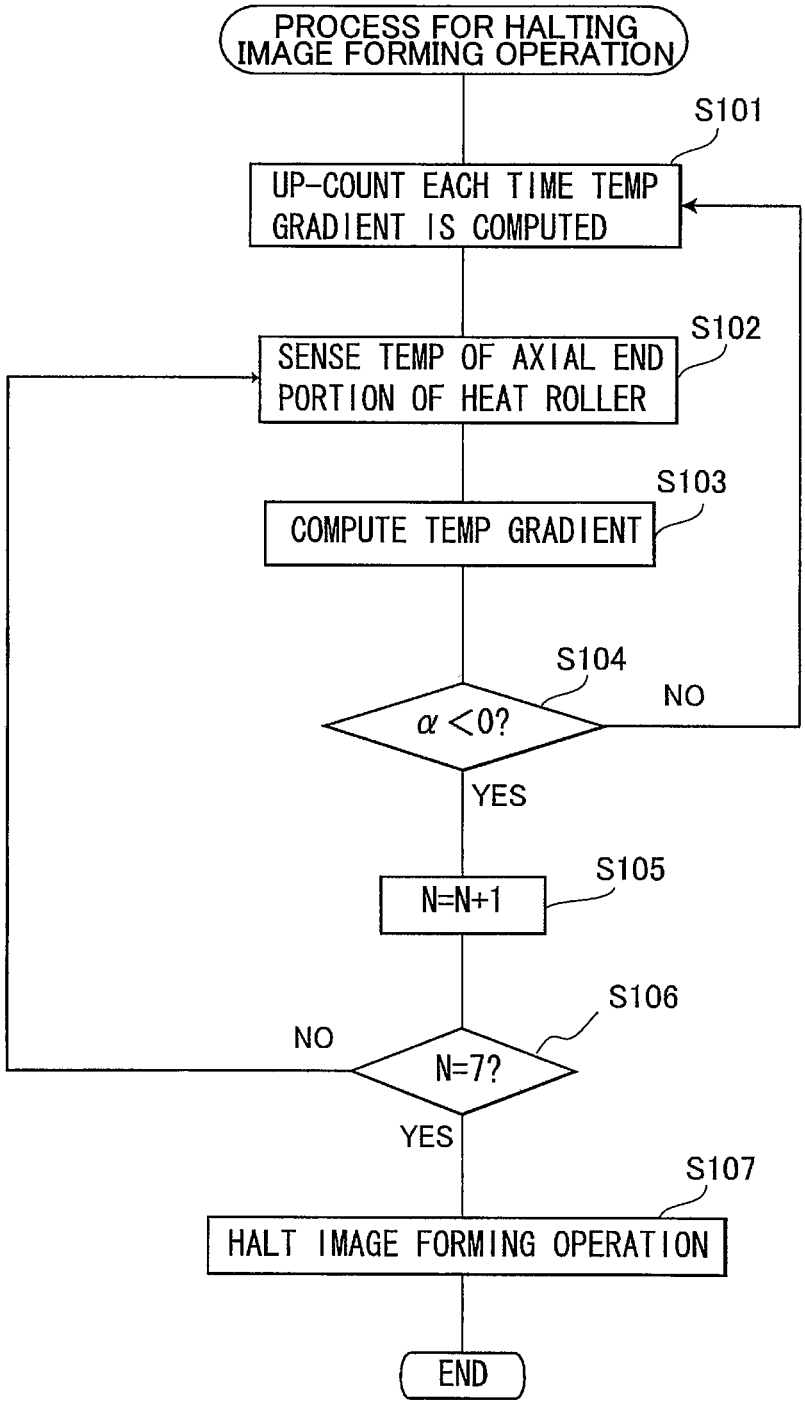
FIG. 6 is a flowchart illustrating a process of halting an image forming operation according to a first embodiment of the invention.
Figure 7:
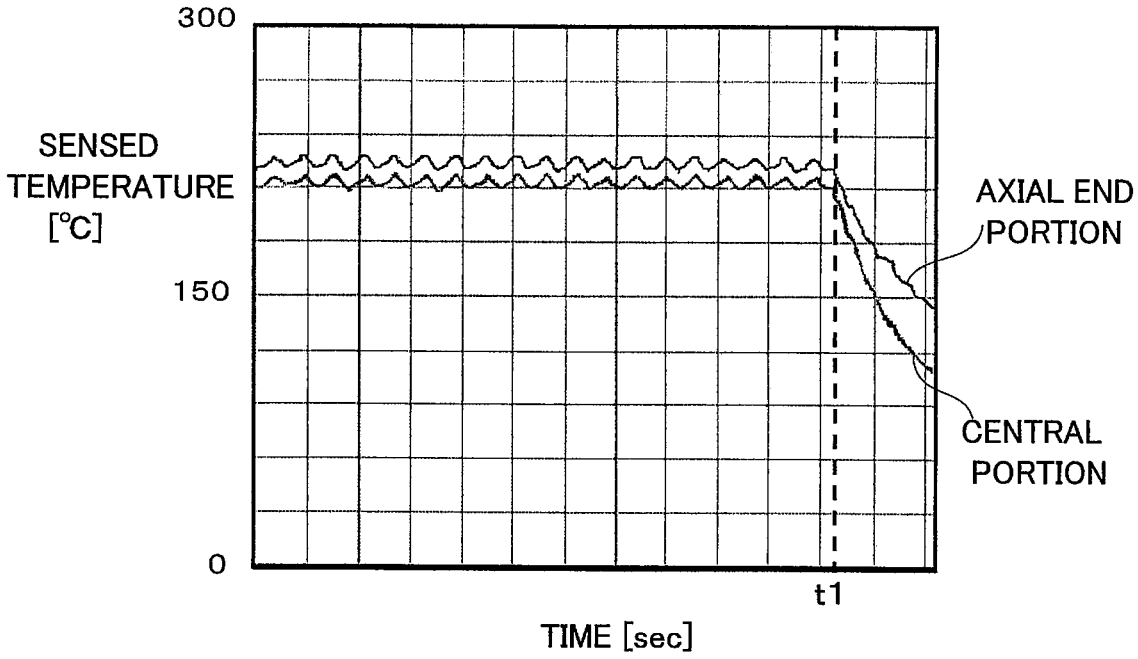
FIG. 7 is a graphical representation showing changes of temperature in central and axial end portions of the hear roller when a thermostat is actuated during the image forming operation performed under the normal circumstance.
Figure 8:
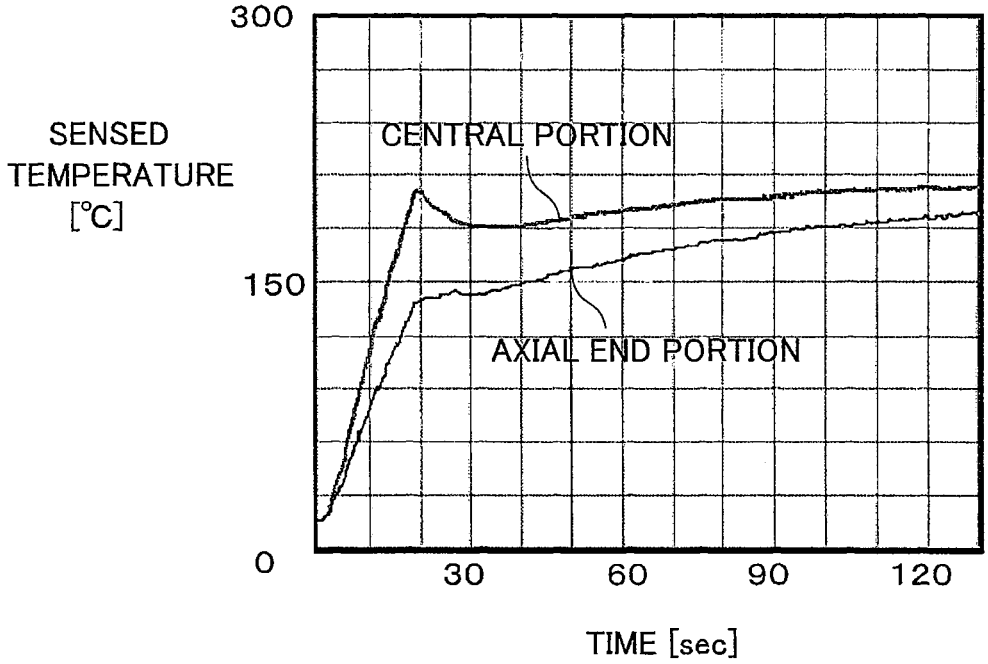
FIG. 8 is a graphical representation showing changes of temperature in central and axial end portions of the heat roller when operated under a circumstance where the environmental temperature is low (10° C.) and the voltage applied to the fixing device is 20% lower than the rated voltage.

Referring next to FIGS. 6 to 8, a process for halting an image forming operation will be described. In the following description, the image forming operation is to be halted following the actuation of the thermostat 76 causing the heat source 65 to be electrically disconnected from the control section 100. It is assumed that as shown in FIG. 7, the thermostat 76 is actuated or turned off at timing t1, so that the heat source 65 does not generate heat thereafter.

The process for halting the image forming operation shown in FIG. 6 is not implemented during a warm-up operation. During the image forming operation, the process of FIG. 6 is implemented, in which the thermistor senses the temperature of the heat roller 61 and computes a temperature gradient representing a rate of change of the temperature in the heat roller 61, and the image forming operation is halted when negative temperature gradient is obtained consecutively. Here, it should be noted that the image forming operation includes a thermal fixing operation, a latent image forming operation, a sheet feed operation, and other operations necessary for forming images on the sheet of paper. When the image forming operation is halted, the thermal fixing operation is also halted.

Referring to the flowchart of FIG. 6, when the image forming operation is commenced, a count number N is set to zero (N=0) in S101. The count number N indicates how many times the temperature gradient a shows negative. In S102, the temperature in the axial end area of the heat roller 61 is sensed with the first thermistor 74 at every sampling time (every one second in this embodiment). Temperature data representing the sensed temperature is stored in a memory (not shown) of the control unit 100 each time the temperature of the heat roller 61 is sensed.

In S103, the temperature gradient a is computed based on two pieces of temperature data, one detected at the current sampling time and the other detected at the sampling time immediately before the current sampling time. Specifically, assuming that temperature T2 is sensed at timing t2, and temperature T3 at timing t3 where T2 is higher than T3 (T2>T3), the temperature gradient $\alpha$1 is obtained by subtracting T2 from T3 (T3−T2).

In S104, determination is made as to whether the computed temperature gradient a is negative or not. The temperature gradient a being negative (S104: YES) indicates that the temperature is decreasing. Here, if the computed temperature gradient $\alpha$1 is negative, the count value N is incremented by one (1). On the other hand, when determination is made that the temperature gradient a is not negative (S104: NO), the routine returns to S101 where the count number N is reset.

In S106, determination is made as to whether or not determination that the temperature gradient $\alpha$ is negative is made consecutively for a predetermined number of times. In this embodiment, the temperature gradients α1, α2, . . . , α6, α7 and on are computed at every one (1) second. If the consecutively computed temperature gradients α1, α2, . . . , α6, and α7 are all negative, the count number N is incremented to seven (7), i.e., N=7. Hence, determination as to whether or not the count number N has reached to seven (7) is affirmed (S106: YES). However, if the count number N has not reached to seven (7) (S106: NO), the routine returns to S102 and sensing the temperature of the heat roller 61 and computation of the temperature gradient α are performed until the count number N has reached to seven (7).

When the count number N is incremented and has reached to seven (7) (S106: YES), it is considered that actuation of the thermostat 76 has caused the temperature of the heat roller 61 to overly lower as shown in FIG.7. In S107, the image forming operation is halted, whereupon the process is ended. When the image forming operation is halted, driving power applied to the heat roller 61 and the pressure roller 62 is interrupted, causing the rotation of these rollers to halt.

With the above-described process, if the heat roller temperature decreases to a certain extent caused by the actuation of the thermostat 76, halting the image forming operation can be carried out accurately and quickly.

If the laser printer 1 is used under a low-temperature and low-voltage circumstance where environmental temperature around the laser printer 1 is lower than 20° C. and the driving voltage applied to the heat roller 61 is lower than the rated voltage, the temperature of the heat roller 61 is low in both the central and axial end areas of the heat roller 61 as shown in FIG. 8. This temperature decrease can be understood from the comparison of two graphs shown in FIGS. 5 and 8. FIG. 5 shows the temperature change in two portions when the laser printer 1 is used under the normal circumstance, and FIG. 8 under the low-temperature and low-voltage circumstance. The temperature in the central area of the heat roller 61 tends to be lowered than in the axial end areas thereof, because heat is dissipated from the central portion thereof attendant to the passage of the sheet of paper. In other words, heat in the sheet contacting area of the heat roller 61 is transferred to the sheet of paper fed while contacting the sheet passage area, resulting in lowering of the temperature in the sheet contacting area. If the image forming operation is halted relying directly upon the temperature of the heat roller 61, the halt operation timing may not be proper under the low-temperature circumstance where the temperature of the heat roller 61 exhibits such a behavior as shown in FIG. 8. In such a circumstance, it is required that the threshold value for halting the image forming operation be set to a low level so that the image forming operation may be halted at a pertinent timing.

The tendency of the time-dependent temperature change of the heat roller 61 can be known from the fact that the temperature gradient of the heat roller 61 is negative. When the negative temperature gradient is consecutively obtained for a predetermined number of times, it can be reasonably assumed that the temperature of the heat roller 61 is continuously decreasing. Therefore, the image forming operation can be halted at a proper timing through detection of the temperature decrease in the heat roller 61.

The image forming operation is halted upon detection of the consecutively occurring negative temperature gradients. As such, the image forming operation is not halted by the temporally occurring temperature decrease in the heat roller 61. It should be noted that the temperature of the heat roller 61 temporally decreases when the centrally disposed thermistor (second thermistor) detects decrease of the temperature resulting from the passage of the sheet of paper. Further, the condition for halting the image forming operation may not be as strict as the case in which halting the image forming operation is triggered in response to the temperature of the heat roller 61. Accordingly, halting the image forming operation can be implemented at a pertinent timing.

In the above-described embodiment, the temperature detection of the heat roller 61 can be achieved accurately, because the temperature used as a basis for computing the temperature gradient is obtained from the first thermistor 74 that senses the temperature in an area outside the sheet passing area in the heat roller 61.

The temperature used as a basis for computing the temperature gradient may be obtained from the centrally disposed thermistor (second thermistor) in lieu of the first thermistor disposed at the axial end of the heat roller 61. The above-described embodiment may be modified in such a manner that two temperature gradients are computed each based on each of the first and second thermistors and the image forming operation is halted when the two temperature gradients thus computed are both negative in the computations consecutively performed at the consecutive sampling timings.

In the embodiment described above, the temperature sampling period, i.e., a duration of time from a sampling timing to the subsequent sampling timing, is 1 (one) second, and the number of times the negative temperature gradient is consecutively obtained is set to 7 (seven) for halting the image forming operation. It would be apparent for those skilled in the art that these values are merely examples and can be changed to any other appropriate values. However, it is desirable that the sampling period be set longer than a duration of time at which the heat roller 61 reverts to a heated state from a temperature decreased state caused by the passage of the sheet of paper. It is also desirable that the sampling period of time be set longer than a duration of time for which the negative temperature gradient appears during the image forming operation.

Next, the second embodiment of the invention will be described while referring to FIG. 9. In the following description, description of the steps common to those in the first embodiment will be omitted. The processes illustrated in FIG. 9 defer from those in the first embodiment in that not only the temperature gradient but also the temperature per se are used as the conditions for halting the image forming operation. In the second embodiment, a temperature lower than a lower limit temperature of the fixing temperature range is stored in the control unit 100 as a threshold value for halting the image forming operation. In this embodiment, the threshold temperature is set to 190° C.

Figure 9:
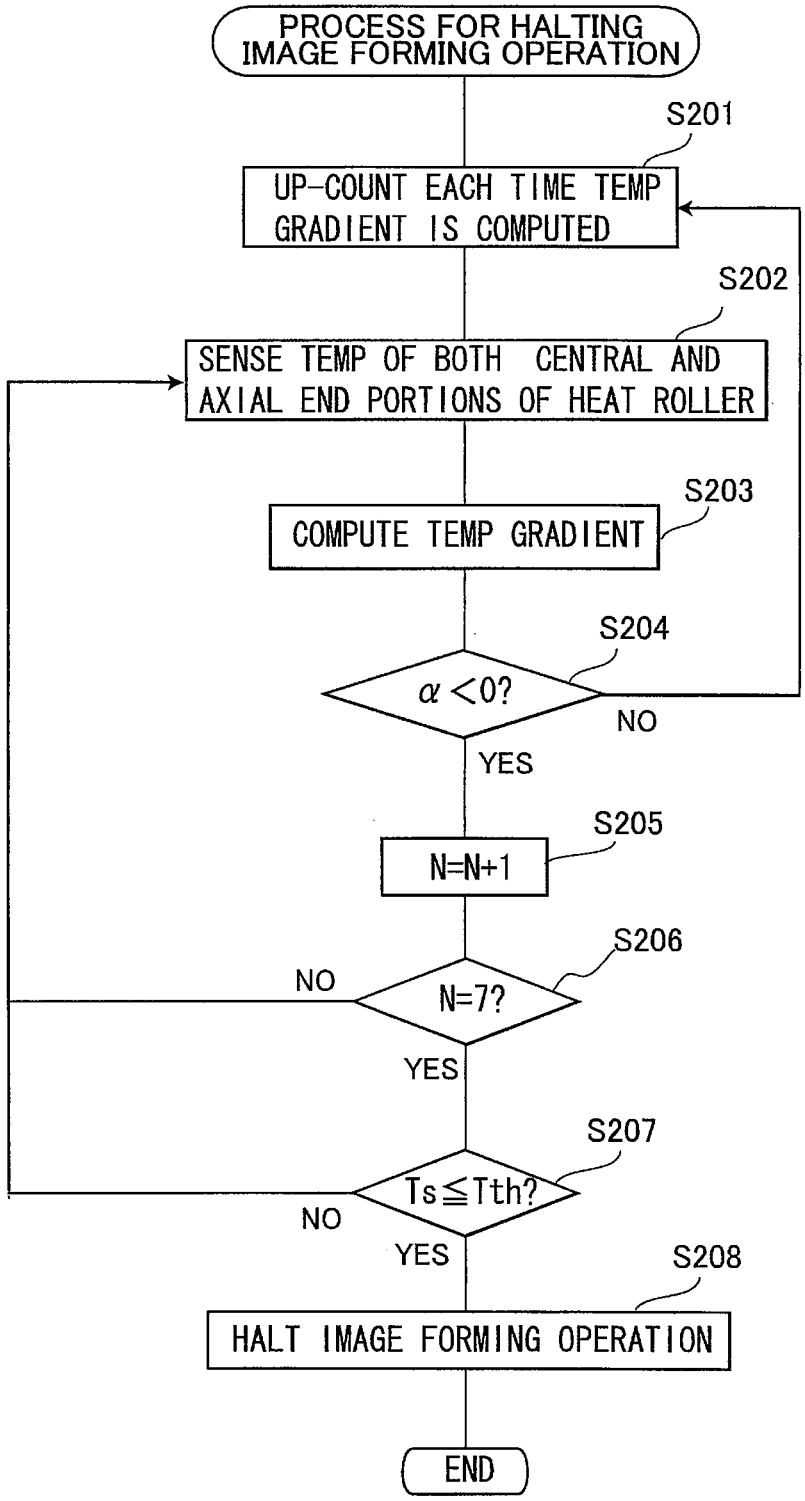
FIG. 9 is a flowchart illustrating a process of halting an image forming operation according to a second embodiment of the invention.

In S201 to S206 of the flowchart shown in FIG. 9, the temperature of the heat roller 61 is sensed at every sampling timing (occurring at every 1 second interval) and determination is made as to whether the temperature gradient α is negative or not (S204). Then, further determination is made as to whether the temperature gradient a being negative is obtained consecutively for a predetermined number of times. Specifically, in S206, when the count number N representing the number of times the temperature gradient results in negative value has reached to seven (7) (S206: YES), the routine proceeds to S207 where determination is made as to whether or not the newly sensed temperature Ts is lower than a threshold temperature value Tth.

When the newly sensed temperature Ts is higher than the threshold temperature value Tth (S207: NO), the image forming operation is not halted but the routine returns to S202 and repeatedly executes the steps S202 to S206. When the newly sensed temperature Ts has become equal to or lower than the threshold temperature value Tth (S207: YES), then the routine proceeds to S208 where the image forming operation is halted, whereupon the process is ended.

With the control as described above, the image forming operation is not halted until negative temperature gradient is not obtained seven times consecutively. Accordingly, the image forming operation is not halted even if the negative temperature gradient is obtained consecutively if the number of times the negative temperature gradient is obtained does not exceed the critical number, seven in this embodiment. As such, halting the image forming operation can be carried out only when it is necessary to do so.

Figure 10:
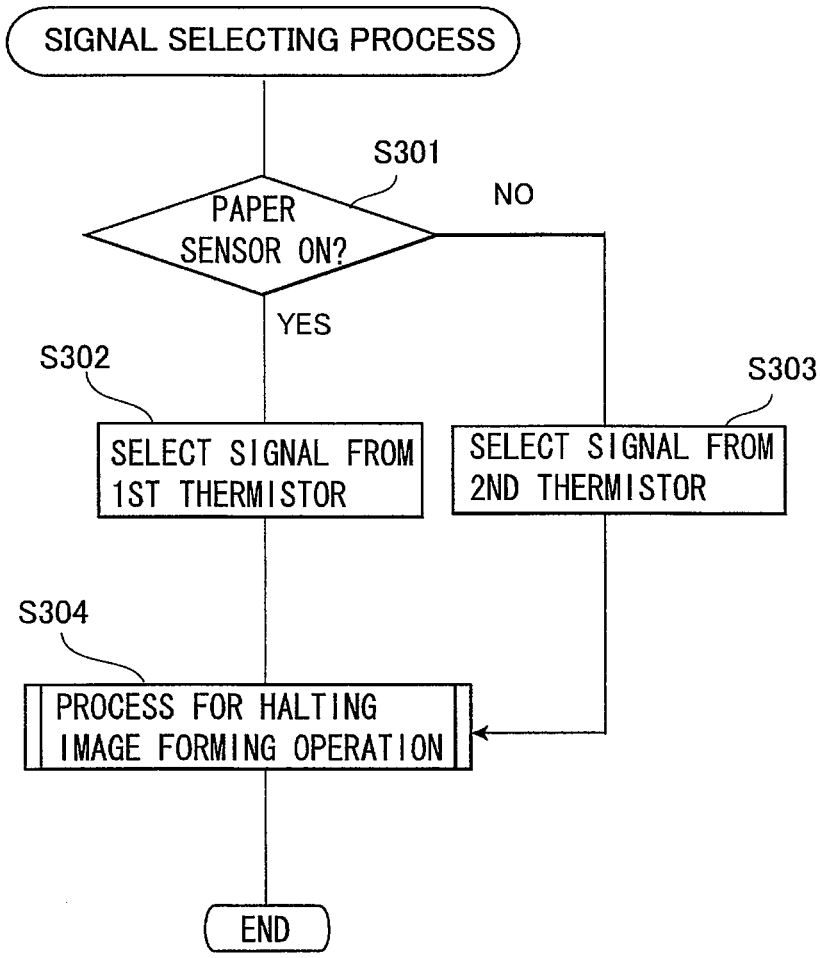
FIG. 10 is a flowchart illustration a process of selecting a thermistor from the ones disposed in central and axial end portion of the heat roller.
Figure 11:
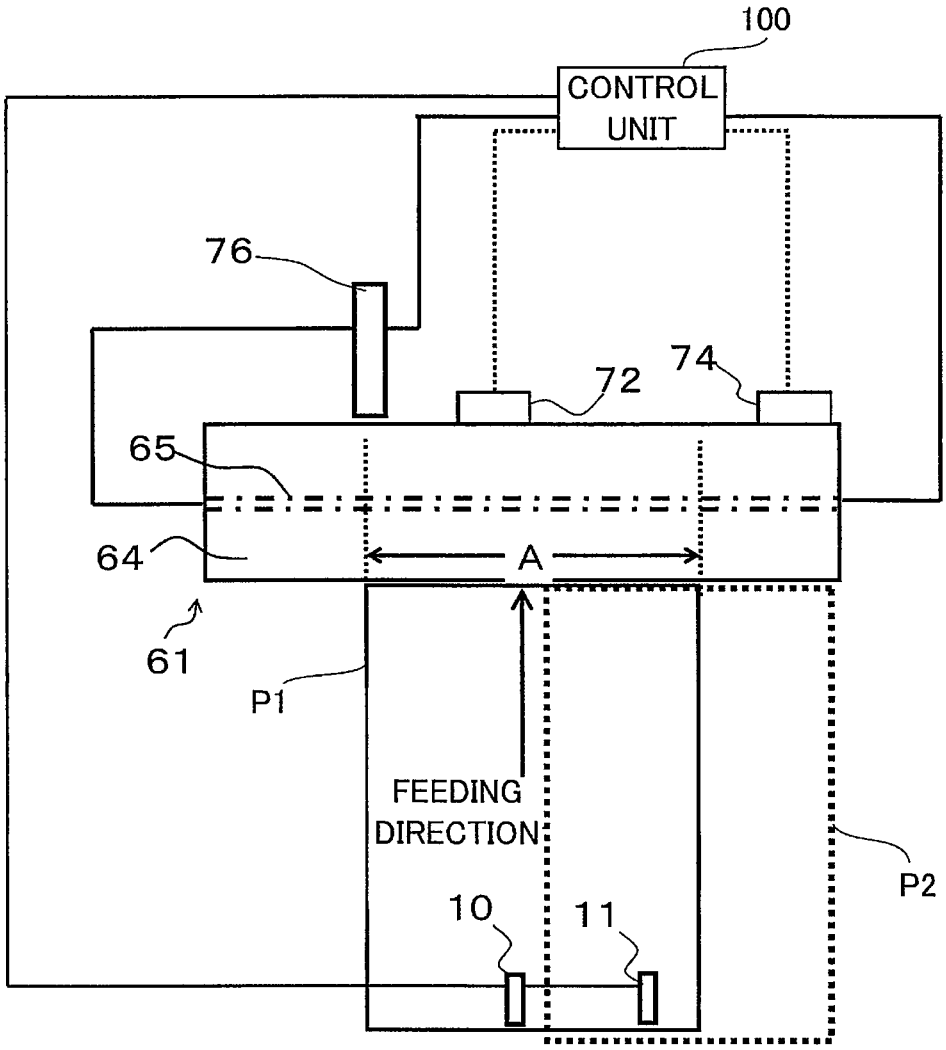
FIG. 11 is an explanatory diagram illustrating the set position of a large-size sheet of paper passing through the nip between the heat roller and the pressure roller of the fixing device.

Finally, the third embodiment of the invention will be described while referring to FIGS. 10 and 11. In the third embodiment, the sheet sensors 10 and 11 are arranged in spaced-apart relation in a direction traversal to the sheet feeding direction as shown in FIG. 11. The sheet sensors 10 and 11 are of a contact type in which a sheet sensing signal is output when the sheet of paper is brought into contact with the sensor. The sheet sensors 10 and 11 are connected to the control unit 100 to apply the sensor output thereto. The sheet sensors 10 and 11 are disposed in such positions where when a sheet of paper P1 is fed in a centered sheet feed path, the sheet of paper P1 is brought into contact with both the sheet sensors 10 and 11. On the other hand, when the sheet of paper P2 is fed in a right-side sheet feed path as shown by a dotted line in FIG. 11, the sheet of paper P2 is brought into contact with only the sheet sensor 11. In this case, the sheet sensor 10 is out of the sheet feeding area and thus not rendered ON even if the sheet of paper P is fed to the fixing unit.

In this third embodiment, the process for halting the image forming operation is executed upon selecting one valid thermistor. The flowchart shown in FIG. 10 selects the thermistor to be used for the process of halting the image forming operation.

When a sheet of paper P is fed from the sheet supply unit 3, determination is made in S301 as to whether or not the passage of the sheet of paper P is sensed by the sheet sensors 10 and 11. When both the sheet sensors 10 and 11 is rendered ON or only the sheet sensor 10 is rendered ON (S301: YES), the signal from the first thermistor 74 is selected (S302) and the process for halting the image forming operation is executed based on the signal from the selected thermistor (S304). In this case, it is assumed that the sheet of paper P is fed along the left-side feeding path and so does not pass the right-side area of the heat roller 61. Hence, the first thermistor 74 disposed in the right axial end portion of the heat roller 61 is selected as a valid sensor, because the first thermistor 74 is less thermally influenced by the passage of the sheet of paper P than the centrally disposed second thermistor 10.

When the sheet sensor 10 remains OFF and only the sheet sensor 11 is rendered ON (S301: NO), the routine proceeds to S303 where the signal from the second thermistor 72 is selected for executing the process for halting the image forming operation (S304). In this case, as shown in FIG. 11, it is assumed that the sheet of paper P is fed along the right-side feeding path and so does not pass the center of the heat roller 61. Hence, the centrally disposed second thermistor 72 is selected as a valid sensor, because the second thermistor 72 is less thermally influenced by the passage of the sheet of paper P than the first thermistor 74.

In this manner, one of the two sheet sensors is selectively used depending upon the sheet feeding path or the size of the paper. Accordingly, the temperature decrease due to the actuation of the thermostat can be accurately sensed irrespective of the sheet feeding route or the size of the paper.

While the invention has been described in detail with reference to the embodiment thereof, it would be apparent to those skilled in the art that various changes and modifications may be made therein without departing from the spirit of the invention.

For example, the temperature decreasing tendency in the heat roller can be sensed not only based on the temperature gradient but also based on a ratio of the two temperature values sensed at different time instants or a division of a previously sensed temperature by the currently sensed temperature or vice versa.

What is claimed is:

1. An image forming apparatus comprising:

a heat source configured to generate heat;

a thermal fixing member configured to be heated by the heat source and to perform a thermal fixing operation by thermally fixing a toner image deposited on a sheet of paper;

a temperature sensing unit configured to sense a temperature of the thermal fixing member and to output temperature data;

a temperature change determining unit configured to:

compute a temperature gradient a consecutive plurality of times, the temperature gradient representing a rate of change of the temperature in the thermal fixing member; and after computing the temperature gradient, determine that the computed temperature gradient is negative or positive for each of the consecutive plurality of times; and a halting unit configured to halt the thermal fixing operation when the determination that the computed temperature gradient is negative is made by the temperature change determining unit each of the consecutive plurality of times and the consecutive plurality of times is a predetermined number of times greater than one.

2. The image forming apparatus according to claim 1, wherein the thermal fixing member is an axially elongated roller having a first peripheral part in sliding contact with the sheet of paper on which the toner image is deposited and a second peripheral part with which the sheet of paper does not contact, wherein the temperature sensing unit is configured to sense a temperature of the second peripheral part of the thermal fixing member.

3. The image forming apparatus according to claim 2, wherein the second peripheral part is an axial end part of the thermal fixing member.

4. The image forming apparatus according to claim 1, further comprising:

a temperature controlling unit configured to control the heat source to maintain the temperature of the thermal fixing member to fall within a predetermined range defined by an upper limit temperature and a lower limit temperature during the thermal fixing operation; and a temperature determining unit configured to determine whether the temperature sensed by the temperature sensing unit falls below a predetermined temperature lower than the lower limit temperature, wherein the halting unit is configured to halt the thermal fixing operation when the determination by the temperature change determining unit is made for the consecutive plurality of times corresponding to the predetermined number of times and the determination made by the temperature determining unit indicates that the temperature sensed by the temperature sensing unit falls below the predetermined temperature.

5. The image forming apparatus according to claim 1, wherein the thermal fixing member is an axially elongated roller having a center peripheral part and an end peripheral part, and the temperature sensing unit comprises a first temperature sensing member configured to sense a temperature of the end peripheral part, and a second temperature sensing member configured to sense a temperature of the center peripheral part, the image forming apparatus further comprising:

a sheet detecting unit configured to sense a position of the sheet of paper on which the toner image is deposited and output a sheet position signal representing the sensed position of the sheet of paper;

a position determining unit configured to determine whether the sheet of paper slides on the center peripheral part of the thermal fixing member or the end peripheral part of the thermal fixing member; and a selecting unit configured to select either the first temperature sensing member or the second temperature sensing member, the first temperature sensing member being selected when the position determining unit determines that the sheet of paper slides on the center peripheral part of the thermal fixing member, the second temperature sensing member being selected when the position determining unit determines that the sheet of paper slides on the end peripheral part of the thermal fixing member, the selecting unit configured to output a selection signal representing a selected temperature sensing member;

wherein the temperature change determining unit is configured to determine that the temperature of the thermal fixing member decreases based further on the selection signal.

6. The image forming apparatus according to claim 1, wherein the temperature sensing unit comprises a thermistor.

7. The image forming apparatus according to claim 1, further comprising a disabling member configured to disable the heat source to stop generation of heat when a temperature of the thermal fixing member exceeds a predetermined temperature higher than the upper limit temperature.

8. The image forming apparatus according to claim 7, wherein the disabling member comprises a thermostat.

9. The image forming apparatus according to claim 7, wherein the disabling member is made from an electrically conductive, thermally meltable resin.

10. An image forming apparatus comprising:

a heat source configured to generate heat;

a thermal fixing member configured to be heated by the heat source and to perform a thermal fixing operation by thermally fixing a toner image deposited on a sheet of paper; and a control unit configured to function as:

a temperature change determination unit configured to:

compute a temperature gradient a consecutive plurality of times, the temperature gradient representing a rate of change of the temperature in the thermal fixing member; and after computing the temperature gradient, determine that the computed temperature gradient is negative or positive for each of the consecutive plurality of times; and a halting unit configured to halt the thermal fixing operation when the determination that the computed temperature gradient is negative is made each of the consecutive plurality of times and the consecutive plurality of times is a predetermined number of times greater than one.

* * * * *